United States Patent [19]

Röck et al.

[11] Patent Number: 4,741,583

[45] Date of Patent: May 3, 1988

[54] FASTENING DEVICE FOR ADJUSTABLE FRONT PLATES

[75] Inventors: Erich Röck, Höchst; Klaus Brüstle, Lauterach, both of Austria

[73] Assignee: Julius Blum Gesellschaft M.B.H., Höchst, Austria

[21] Appl. No.: 825,558

[22] Filed: Jan. 30, 1986

[30] Foreign Application Priority Data

Feb. 12, 1985 [AT] Austria ..... 399/85

[51] Int. Cl.[4] ..... A47B 88/00

[52] U.S. Cl. ..... 312/330 R; 403/370

[58] Field of Search ..... 312/330 R, 257 R, 140; 403/367, 370, 231

[56] References Cited

U.S. PATENT DOCUMENTS 3,113,358 12/1963 Zell et al. ..... 403/231 X
4,036,371 7/1977 Michel ..... 403/231 X
4,589,710 5/1986 Rock et al. ..... 312/330 R

FOREIGN PATENT DOCUMENTS 3148066 10/1982 Fed. Rep. of Germany ... 312/330 R

*Primary Examiner*—Joseph Falk
*Attorney, Agent, or Firm*—Wenderoth, Lind & Ponack

[57] ABSTRACT

A fastening device for adjustably mounting a drawer front plate, a includes a suppporting part arranged at each side of the drawer and having a fastening flange aligned vertically to the front plate and a holding flange aligned parallel to the front plate. The holding flanges extend at angles with respect to the fastening flanges. Holding parts are fastened to the front plate by means of screws. The holding parts include hooks that are engageable into the holding flanges. A tightening member is held at each supporting part. The tightening members are pressable against the holding parts and thus provide a bracing engagement between the holding parts and the supporting parts.

11 Claims, 2 Drawing Sheets

SURFACE AREA

POROSITY

PORE VOLUME

FASTENING DEVICE FOR ADJUSTABLE FRONT PLATES

FIELD AND BACKGROUND OF THE INVENTION

The invention relates to a fastening device for adjustably mounting front plates of extractable furniture parts, in particular drawers. A supporting part is fastened at each side of the furniture part, in particular at the guide rails of a pull-out guide assembly thereof, and includes a fastening flange aligned vertically to the front plate and a holding flange aligned parallel to the front plate. The front plate is fastened, for example by means of screws, to holding parts which are engageable into the holding flanges at upper and lower bearing or support points.

It is the function of fastening devices of the above-mentioned kind, which are widely used in the production of modern kitchen furniture, to provide a fastening means for the front plates of drawers or of extractable shelves which allows adjustment and readjustment of the front plate so that in the case of greater tolerances, which result, for example, from the mounting of the guide rails, the front plate can be uniformly aligned and uniform joins are visible when the piece of furniture is viewed from the front.

In spite of the necessary possible adjustments, a fitting of the above-mentioned kind should permit easy mounting and fixing of the front plate to the drawer. The fixing and adjusting means should be easily accessible, and the front plate should be securely held.

SUMMARY OF THE INVENTION

It is the object of the invention to provide a particularly simple fastening device which allows quick fastening of the front plate.

The object of the invention is attained by arranging a wedge or tightening member at each side of the drawer and which abuts between the holding part and the supporting part or between the front plate and the supporting part, and provides a bracing engagement between the holding part and the supporting part.

By means of the fastening device according to the invention, the front plate can be easily engaged into the holding flanges from the front. The front plate is immediately securely held, but lateral displacement of the front plate is possible, nevertheless. When the front plate is in the desired position, the wedge or tightening member is operated and the front plate is fixed.

It is advantageously provided that the wedge member is held by a screw at the fastening flange of the supporting part, that the wedge member is guided by flaps which are bent from the fastening flange, and that the holding flange has a perforation through which the clamp or wedge member projects, the wedge member being movable towards the fastening flange by means of the screw.

Fastening of the wedge member is facilitated in that the flaps have bevelled portions which rest against the inclined faces of the wedge member.

Grooves into which the flaps extend are advantageously formed in the wedge member, such that the wedge member is thus guided by the fastening flange.

BRIEF DESCRIPTION OF THE DRAWINGS

Embodiments of the invention will be described in more detail below with reference to the accompanying drawings in which.

DESCRIPTION OF THE PREFERRED EMBODIMENTS

Figure 1:
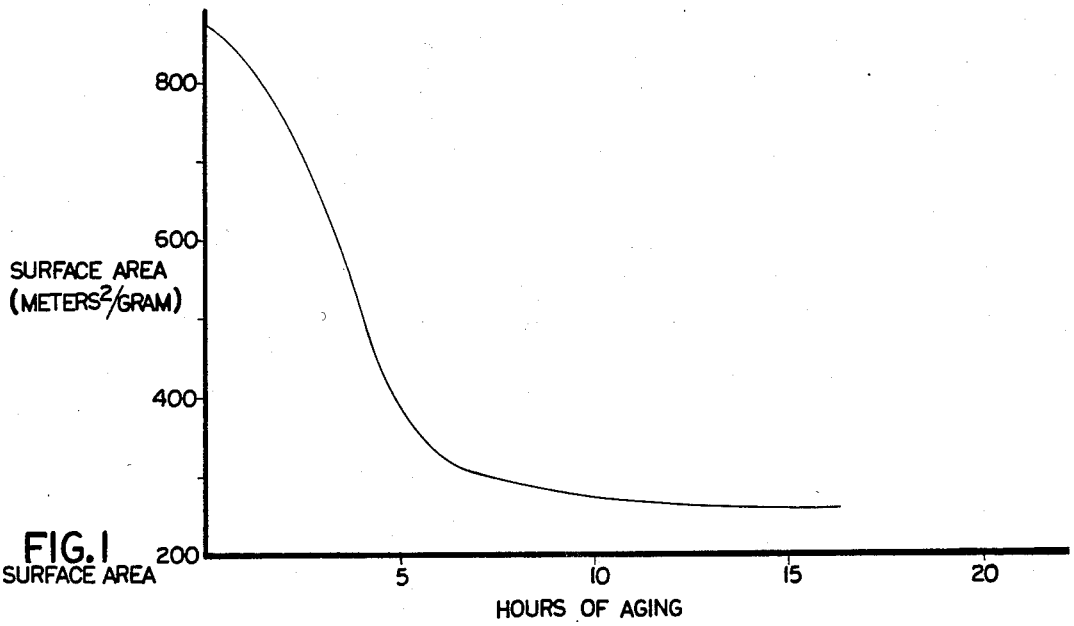
FIG. 1 is a side view of a fastening device according to a first embodiment of the invention, parts thereof being shown in section.
Figure 2:
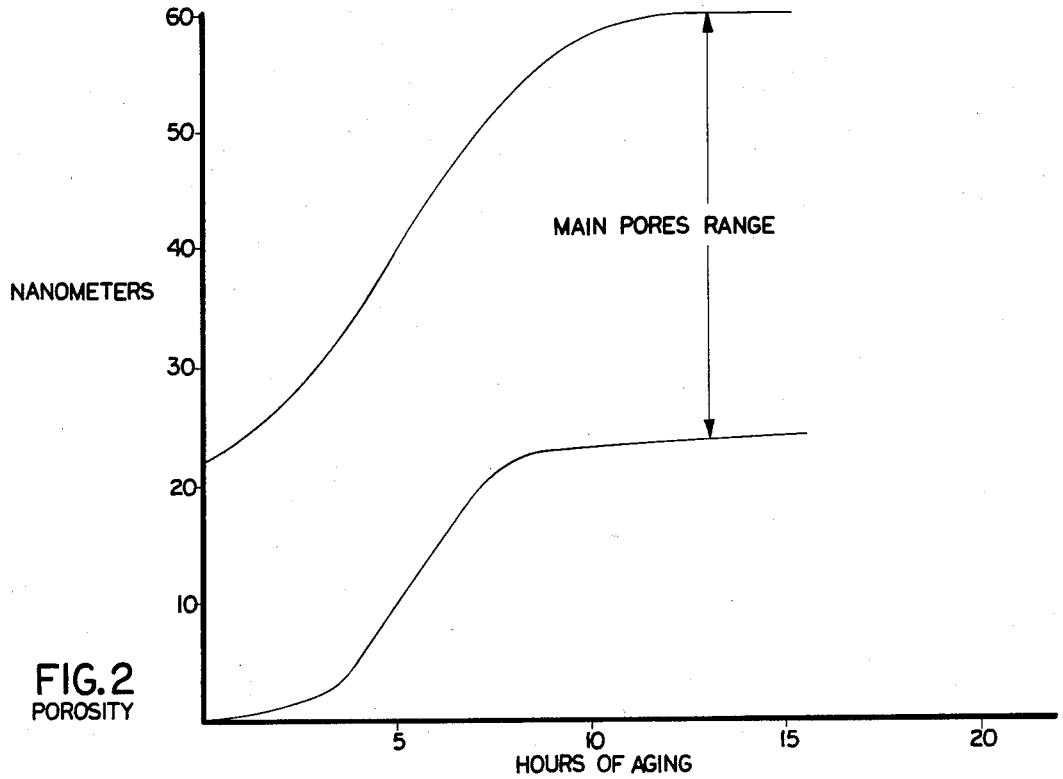
FIG. 2 is a view from the direction of arrow A of FIG. 1.

As can be seen from FIGS. 1 and 2, a drawer front plate 1 is fastened to holding parts 2, which are arranged at the left and the right of the front plate 1, by means of screws 6.

The holding parts 2 are advantageously punched from sheet metal and have two hook members 12. The holding parts 2 are engageable with respective supporting parts 3 by means of hook members 12.

Each supporting part 3 includes a fastening flange 8 which extends vertically and perpendicularly to the front plate 1 and which is, in the illustrated embodiment, directly fastened to a drawer guide and also forms the side wall of the drawer. A holding flange 9 is bent to extend transversely from each fastening flange 8. The holding flanges 9 are aligned parallel to the front plate 1, and each has an opening 11 which is arranged substantially centrally and through which extends a wedge or clamp member 4 when the front plate 1 is in the mounted position.

The hook members 12 of the holding parts 2 extend behind the holding flanges 9 of supporting parts 3. Holding flanges 9 are provided with vertical corrugations or ribs 13 which prevent unintentional displacement of the front plate 1. The hook members 12 project through holes 14 in the holding flanges 9 and contact ribs 13.

Each wedge member 4 is held by a screw 5 and is movable by means of screw 5. Screw 5 engages in a female thread in the respective wedge member 4 and projects through a hole in the respective fastening flange 8. Screw 5 is received with clearance in the hole of the fastening flange 8 so that a displacement of the screw 5 radially thereof, which is effected by the displacement of the wedge member 4, is possible.

Two flaps 15 which have bevelled portions 15' are punched out of each fastening flange 8.

Flaps 15 are guided in respective grooves 16 in the respective wedge member 4 and thus position or hold the wedge member 4 vertically.

Figure 3:
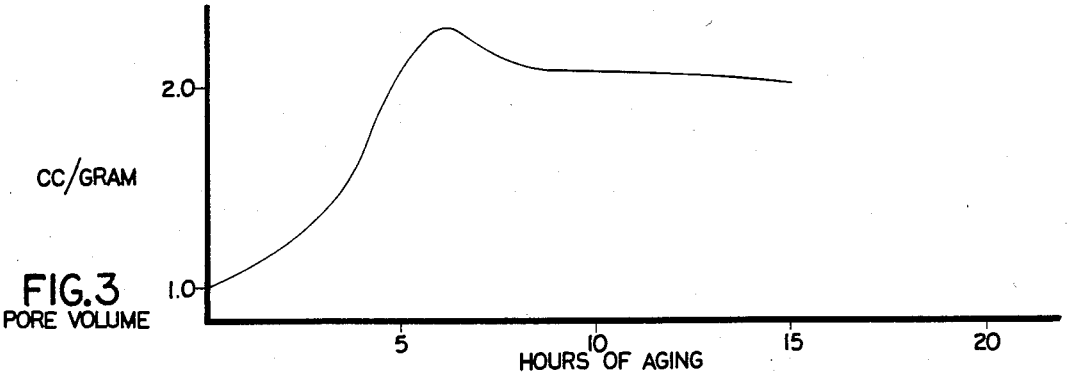
FIG. 3 is a view from the direction of arrow B of FIG. 1, but sectioned through a wedge member thereof.
Figure 6:
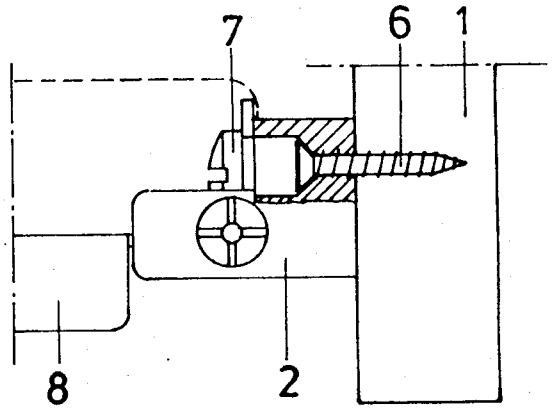
FIG. 6 is a top view of such fastening device, parts thereof being shown in section.
Figure 7:
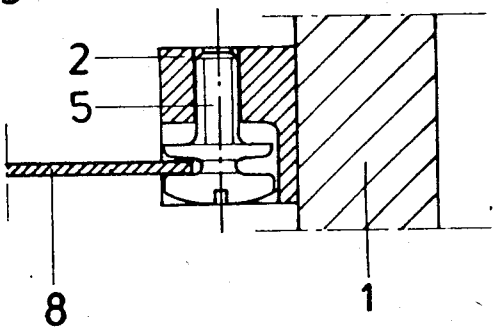
FIG. 7 is a sectional view along line I—I of FIG. 4.

As can be seen from FIG. 3, a surface of wedge member 4 is inclined and thus forms an inclined face 16' which is complementary to the respective bevelled portions 15' of the flaps 15.

As also can be seen from FIG. 3, by fastening the screw 5, the wedge member 4 not only is moved towards the fastening flange 8 but also is pushed towards the front plate 1 by means of the bevelled portions 15' and the inclined faces 16'.

Each wedge member 4 projects through the respective opening 11 and presses against the holding part 2 so that holding flange 9 of supporting part 3 is clamped against hook members 12 of holding part 2.

To improve the clamping effect, the holding part 2 is provided with horizontal corrugations or ribs 17 against which the wedge member 4 presses.

As already mentioned, mounting of the front plate 1 is quickly effected by means of the fastening device according to the invention. The front plate 1 onto which the holding parts 2 are mounted is engaged with the holding flanges 9 of the supporting parts 3 by means of the hook members 12. Then, the front plate 1 is vertically and laterally aligned by hand, which is possible because of the size of holes 14 and of the dimensions of hook members 12. When the front plate 1 is in the desired position, the screws 5 are fastened, and thereby the wedge members 4 are pressed against the holding parts 2, thus locking the front plate 1.

In the embodiment according to FIGS. 4 to 7, the front plate 1 is also engaged into supporting parts **3*a* by means of holding parts 2*a*. The holding parts 2*a* are fastened to the front plate 1 by means of screws 6. Each supporting part 3*a* includes a fastening flange 8 extending vertically and transversely to the front plate 1 and a holding flange 9*a* aligned parallel to the front plate 1. In this embodiment, the holding flange does not extend over the full length of the respective supporting part 3*a* but is formed only by a flap bent out of the fastening flange 8 substantially in the center of the height of the front plate 1**.

Instead of the wedge member 4, a fixing screw 7 is threaded into the holding part **2*a* and clamps holding flange 9*a* of supporting part 3*a* to holding part 2*a***.

A screw 5 is arranged in a lower region of the fastening device and also is threaded into the supporting part **2*a* and is engaged by fastening flange 8 to be fixed with respect axially of screw 5. By turning the screw 5, the front plate 1** can be adjusted in the lateral direction.

Each supporting part **3*a* has at the upper end thereof an angled flange 20 against which abuts a height adjustment screw 21 which is threaded through holding part 2*a***.

Each holding part **2*a* has hook members 12 which are engageable into corresponding recesses of the respective supporting part 3*a*. The front plate 1 thus is supported on the drawer, but adjustments of the relative position of the front plate 1** are possible.

Lateral adjustment is effected, as already mentioned, by turning the screw 5. By turning the height adjustment screw 21, the front plate 1 can be adjusted with respect to horizontal joints.

When the front plate 1 is in the desired position, the fixing screw 7 is fastened.

Figure 5:
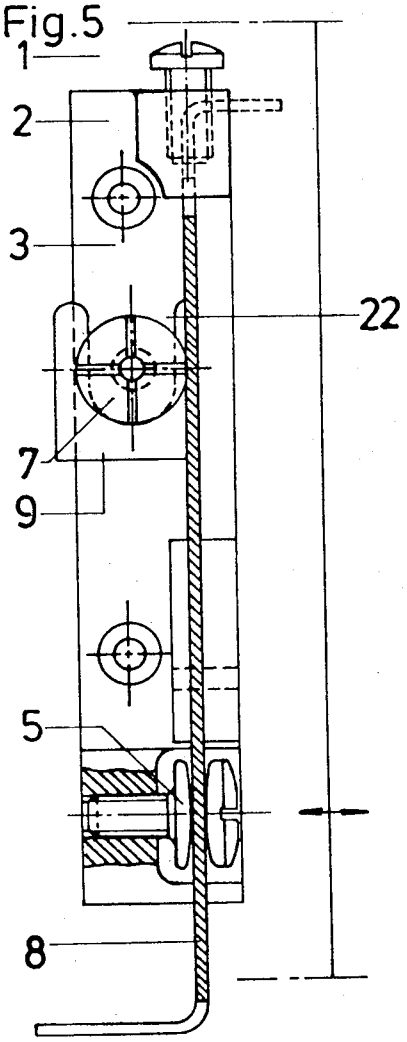
FIG. 5 is a view from the direction of arrow A of FIG. 4, partially in section.
Figure 4:
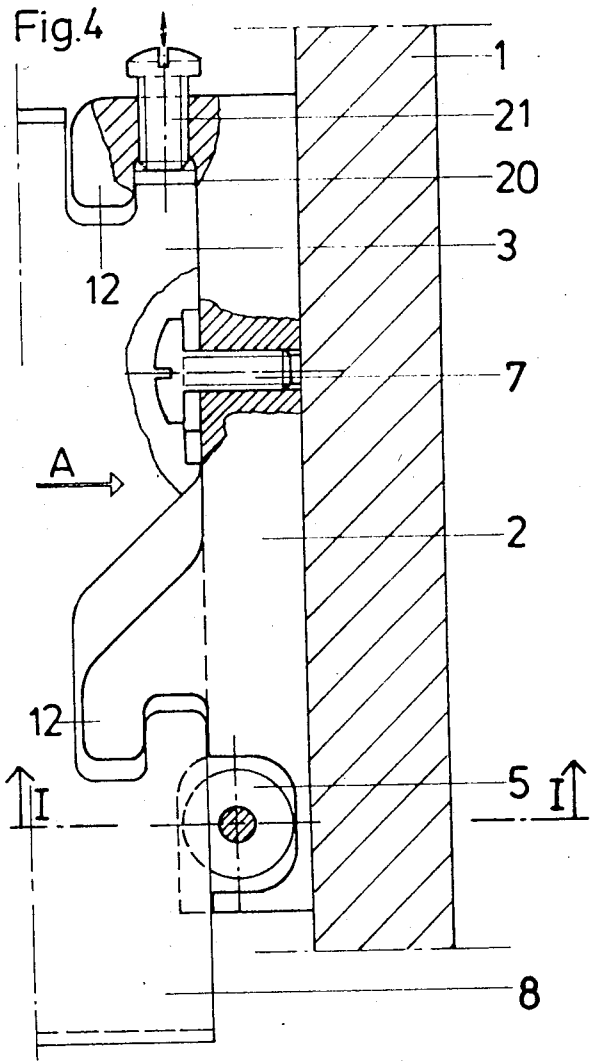
FIG. 4 is a side view of a second embodiment of a fastening device, partially in section
Figures 1, 2, 3:
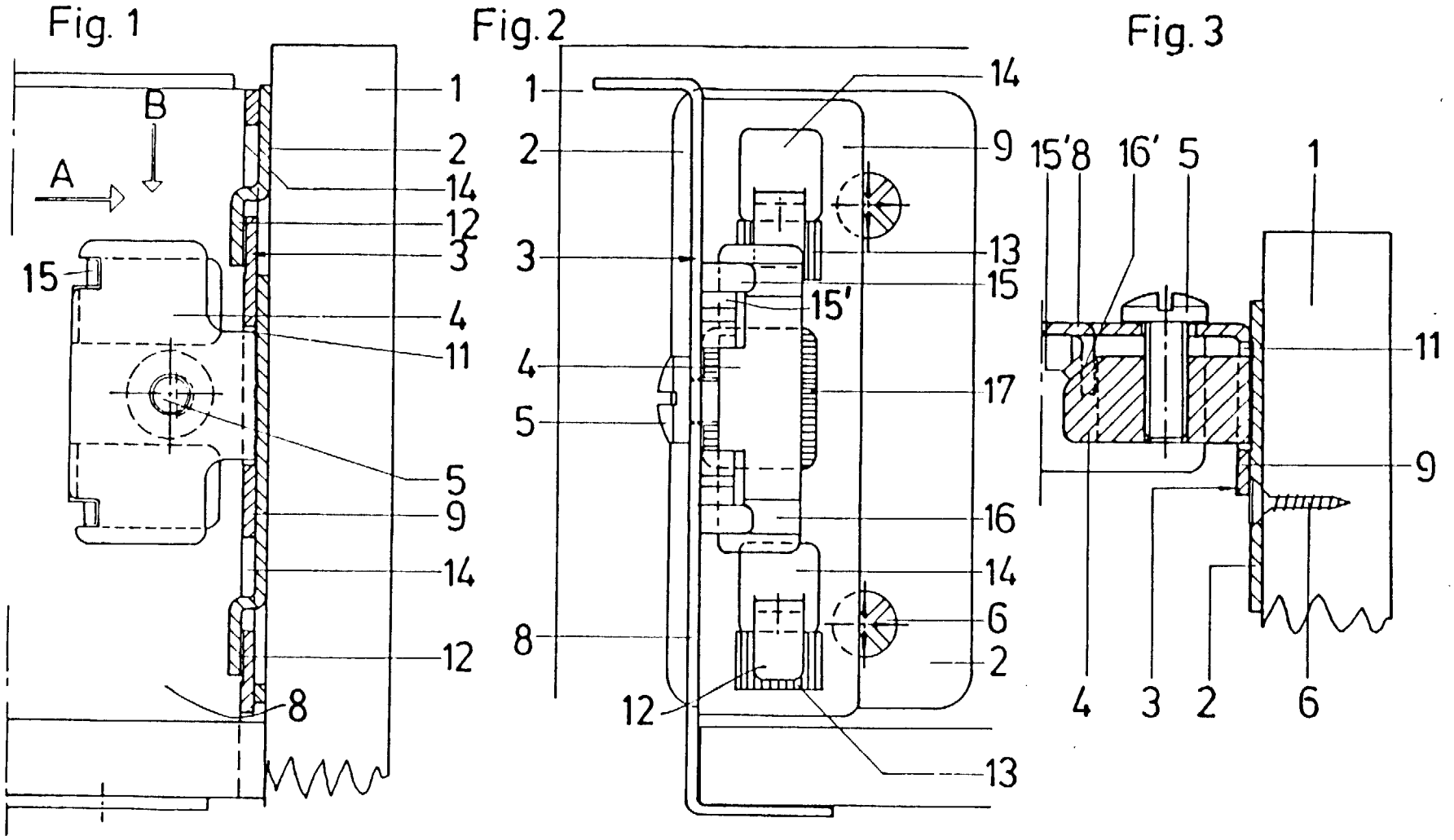

As can be seen from FIG. 5, the fixing screw 7 projects through an upwardly open slot 22 in the flap forming the holding flange **9*a*. The size of upwardly open slot 22 is relatively great so that the displacement of the front plate 1 is not hindered by the fixing screw 7**.

What is claimed is:

1. A fastening device for use on each of opposite sides of an extractable furniture part for adjustably mounting a front plate on the extractable furniture part, said fastening device comprising:

a supporting part to be fixed to a respective side of the extractable furniture part, said supporting part including a vertical fastening flange extending in a direction to be transverse to the front plate when the front plate is mounted and a holding flange extending in a direction transverse to said fastening flange and to be parallel to the front plate when the front plate is mounted, said holding flange having therethrough an opening;

a holding part to be fixed to the front plate, said holding part having means for engaging upper and lower portions of said supporting part; and means for forming a bracing engagement between said supporting part and said holding part or the front plate and thereby for clamping together said supporting and holding parts, said means comprising a clamp member supporting by said fastening flange and extending through said opening in said holding flange, screw means extending through said fastening flange and connected to said clamp member for selectively moving said clamp member toward said fastening flange, and cooperating means provided on said clamp member and said fastening flange for, upon said screw means moving said clamp member toward said fastening flange, also moving said clamp member through said opening in said holding flange into clamping engagement with said holding part or the front plate.

2. A device as claimed in claim 1, wherein said clamp member has therein at least one generally horizontal groove, and said fastening flange has extending therefrom at least one flap extending into said groove and thereby guiding said clamp member during movement thereof toward said fastening flange.

3. A device as claimed in claim 2, wherein said cooperating means comprise complementary, abutting inclined surfaces of said flap and said clamp member.

4. A device as claimed in claim 3, wherein said inclined surface of said clamp member is located within said groove.

5. A device as claimed in claim 1, wherein said screw means extends with clearance through said fastening flange and is threaded into said clamp member.

6. A device as claimed in claim 1, wherein said clamp member clamps through said opening against said holding part.

7. A device as claimed in claim 6, further comprising ribs on said holding part at the area thereof clamped by said clamp member.

8. A device as claimed in claim 7, wherein said ribs extend substantially horizontally.

9. A device as claimed in claim 1, wherein said holding flange has extending therethrough upper and lower holes, and said engaging means comprise upper and lower hook members extending from said holding part through said upper and lower holes, respectively, thereby supporting said holding part and the front plate on said supporting part prior to operation of said bracing means, and whereby upon movement of said clamp member into said clamping engagement said hook members are clamped against said holding flange.

10. A device as claimed in claim 9, further comprising ribs on said holding flange at upper and lower areas thereof clamped by respective said hook members.

11. A device as claimed in claim 10, wherein said ribs extend substantially vertically.

* * * * *

UNITED STATES PATENT AND TRADEMARK OFFICE

CERTIFICATE OF CORRECTION

PATENT NO. : 4,741,583

DATED : May 3, 1988

INVENTOR(S) : Erich Rock and Klaus Brustle

It is certified that error appears in the above-identified patent and that said Letters Patent is hereby corrected as shown below:

Title Page and Figs. 1, 2 and 3 should be deleted.

Title Page and Figs. 1, 2 and 3 should appear as shown on the attached sheets.

Signed and Sealed this

Eighteenth Day of April, 1989

*Attest:*

DONALD J. QUIGG

*Attesting Officer*

*Commissioner of Patents and Trademarks*

United States Patent [19]

Röck et al.

[11] Patent Number: 4,741,583

[45] Date of Patent: May 3, 1988

[54] FASTENING DEVICE FOR ADJUSTABLE FRONT PLATES

[75] Inventors: Erich Röck, Höchst; Klaus Brüstle, Lauterach, both of Austria

[73] Assignee: Julius Blum Gesellschaft M.B.H., Höchst, Austria

[21] Appl. No.: 825,558

[22] Filed: Jan. 30, 1986

[30] Foreign Application Priority Data

Feb. 12, 1985 [AT] Austria ..... 399/85

[51] Int. Cl.[4] ..... A47B 88/00

[52] U.S. Cl. ..... 312/330 R; 403/370

[58] Field of Search ..... 312/330 R, 257 R, 140; 403/367, 370, 231

[56] References Cited

U.S. PATENT DOCUMENTS

| | | | |
|---|---|---|---|
| 3,113,358 | 12/1963 | Zell et al. | 403/231 X |
| 4,036,371 | 7/1977 | Michel | 403/231 X |
| 4,589,710 | 5/1986 | Rock et al. | 312/330 R |

FOREIGN PATENT DOCUMENTS

| | | | |
|---|---|---|---|
| 3148066 | 10/1982 | Fed. Rep. of Germany | 312/330 R |

*Primary Examiner*—Joseph Falk

*Attorney, Agent, or Firm*—Wenderoth, Lind & Ponack

[57] ABSTRACT

A fastening device for adjustably mounting a drawer front plate, a includes a suppporting part arranged at each side of the drawer and having a fastening flange aligned vertically to the front plate and a holding flange aligned parallel to the front plate. The holding flanges extend at angles with respect to the fastening flanges. Holding parts are fastened to the front plate by means of screws. The holding parts include hooks that are engageable into the holding flanges. A tightening member is held at each supporting part. The tightening members are pressable against the holding parts and thus provide a bracing engagement between the holding parts and the supporting parts.

11 Claims, 2 Drawing Sheets

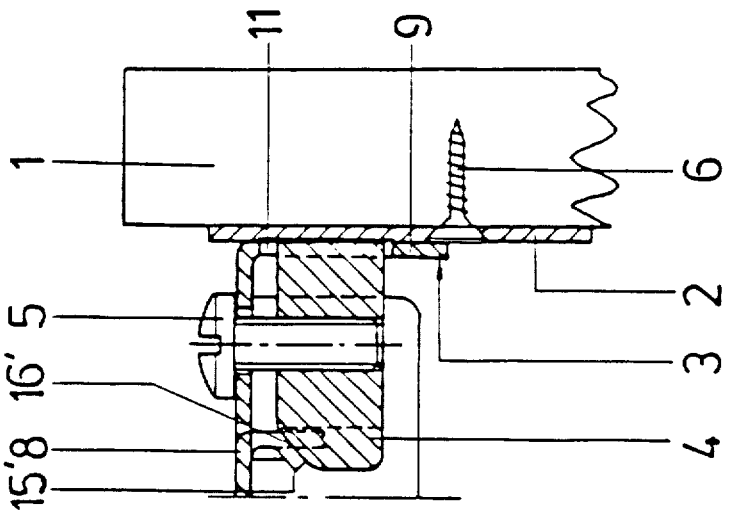

1
11
9
6
2
3
4
5
16'
8
15'

14
9
13
15
15'
17
16
14
6
2
13
12
1
2
3
4
5
8

1
2
14
12
3
4
11
5
9
14
12
8
B
A
15